United States Patent [19]

Ostyn

[11] 4,370,247

[45] Jan. 25, 1983

[54] GEAR AND AXLE OIL COMPOSITION

[75] Inventor: Marcel A. Ostyn, Bois Guillaume, France

[73] Assignee: Exxon Research and Engineering Co., Florham Park, N.J.

[21] Appl. No.: 287,869

[22] Filed: Jul. 28, 1981

[30] Foreign Application Priority Data

Jul. 29, 1980 [GB] United Kingdom ....., 8024774

[51] Int. Cl.[3] ..... C10M 1/20; C10M 1/26; C10M 1/48

[52] U.S. Cl. ..... 252/46.7; 252/52 A; 252/56 R

[58] Field of Search ..... 252/46.7, 52 A, 52 R, 252/56 R, 56 S

[56] References Cited

U.S. PATENT DOCUMENTS 3,013,971 12/1961 Mastin ..... 252/46.7 X
3,030,304 4/1962 Elliot et al. ..... 252/46.7
3,062,743 11/1962 Manteuffel et al. ..... 252/46.7
4,088,589 5/1978 Rossi et al. ..... 252/56 R
4,164,475 8/1979 Schieman ..... 252/46.7

FOREIGN PATENT DOCUMENTS 1445009 7/1965 France .
786950 11/1957 United Kingdom .

*Primary Examiner*—W. J. Shine
*Attorney, Agent, or Firm*—R. Pitkin; Eugene Zagarella, Jr.

[57] ABSTRACT

A gear and axle oil composition comprises (a) conventional gear/axle grade mineral oil; (b) a polyoxyalkylene glycol of viscosity from 5 to 30 cSt at 100° C.; and (c) at least one di-$C_8$ to $C_{12}$ alkyl ester of a dicarboxylic acid. The mineral oil component is never greater than 50 mass % of the total composition. Power loss due to friction is decreased, giving useful fuel saving.

12 Claims, 1 Drawing Figure

FZG RIG TEST (CEC-L-07-A-71)
Power Losses
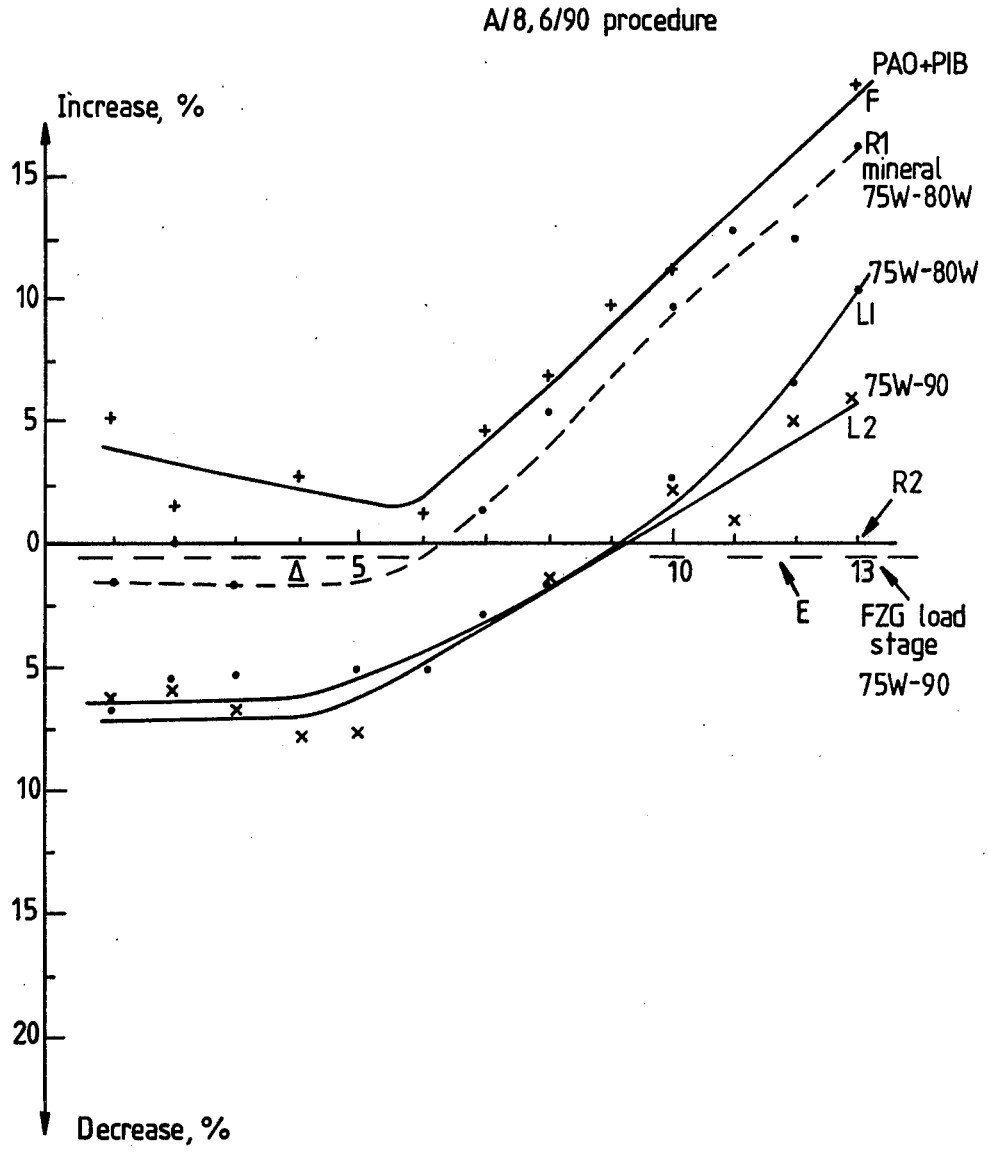

GEAR AND AXLE OIL COMPOSITION

BACKGROUND OF THE INVENTION

1. Field of the Invention

The invention relates to a gear and axle lubricant oil composition, more particularly for automotive gears, for reducing power loss due to friction, whereby fuel saving may be achieved.

2. Discussion of the Prior Art

For some years efforts have been made to reduce fuel consumption of automobiles and heavy goods vehicles and the like.

Several of the solutions proposed are of a purely mechanical nature. Other approaches have involved a search for lubricants which will reduce overall friction of components, whereby energy saving is possible. At the present time, in the field of automotive gear or axle oils, there are employed conventional mineral oil compositions or fully synthetic compositions, for example compositions based on synthetic esters or on polyalphaolefins plus polyalkenes. In U.K. Pat. No. 786950 there is disclosed a fully synthetic lubricating composition, said to be particularly suitable for gas turbine bearings, which comprises (a) a liquid ester (such as di (2-ethylhexyl) sebacate or adipate), (b) a polyoxyalkylene glycol or mono- or di-ether thereof and (c) a Group II metal salt of either an aromatic carboxylic acid or a phenol.

SUMMARY OF THE INVENTION

With the ever-increasing need to conserve automotive fuel consumption a major requirement of a gear or axle oil is that it decreases power loss due to friction. However, this alone is not sufficient. The oil must in addition give an acceptable degree of anti-wear protection to the components being lubricated.

BRIEF DESCRIPTION OF THE DRAWING

FIG. 1 is a graph showing the results of a FZG rig test.

It is an object of the present invention to provide a lubricating composition suitable for use as a gear or axle oil which, in comparison with a known type of oil, enables a decrease in power loss to be achieved for the same, or better, degree of anti-wear protection.

According to the present invention a lubricating composition suitable for use as a gear or axle oil comprises:

(a) from 5 to 50 mass % of mineral oil of conventional gear oil or axle oil grade;

(b) from 5 to 30 mass % in total of at least one polyoxyalkylene glycol having a viscosity of from 5 to 30 cSt at 100° C.;

(c) from 25 to 60 mass % in total of at least one di-$C_8$ to $C_{12}$ alkyl ester of a dicarboxylic acid;

(d) from 0 to 15 mass % in total of at least one conventional extreme pressure agent;

(e) from 0 to 8 mass % in total of at least one conventional VI improver; and (f) from 0 to 5 mass % of at least one conventional pour point depressant; the components (a) to (f) totalling together 100 mass %, and the components (a) to (f) forming at least 95 mass % of the whole lubricating oil composition.

Desirably the composition comprises:

from 10 to 40 mass % of component (a), from 10 to 20 mass % of component (b), from 30 to 35 mass % of component (c), from 2 to 10 mass % of component (d), from 2 to 5 mass % of component (e), and from 0.1 to 3 mass % of component (f);

the components (a) to (f) totalling together 100 mass %, and the total forming at least 95 mass % of the whole lubricating oil composition.

Preferably the components (a) to (f) are present in the following mass %: (a) 15 to 40; (b) 14 to 18; (c) 35 to 50; (d) 6 to 7; (e) 2 to 8; and (f) 0.2 to 1. The said preferred quantities may be taken individually and not necessarily with a preferred quantity of any others of the said components.

The lubricating oil compositions of the invention may, if desired, contain amounts of one or more conventional additives selected from anti-corrosion agents, antioxidants, seal-swellants, de-odourizers, dyes and fluorescent colouring agents. In that case to the total amount employed of all such conventional additives is not more than 5 mass % of the total lubricating oil composition.

Unless stated otherwise, the amounts of components employed refer to amounts of active ingredients of those components and excludes, for example, any solvents, diluents etc. for the components.

Preferably the polyoxyalkylene glycol is one having a viscosity in the range 20 to 25 cSt at 100° C.

Preferred polyoxyalkylene glycols are polyoxyethylene glycol, polyoxypropylene glycol or polyoxyethylene-polyoxypropylene glycol. A polyoxyethylene-polyoxypropylene glycol of molecular weight of approximately 2000 is a particularly preferred component. The polyoxyalkylene glycols are also known as polyalkylene glycols or polyoxyalkylenes.

The diester component is preferably of an aliphatic dicarboxylic acid; suitably of the formula $HOOC(CH_2)_nCOOH$, where n is from 3 to 8. Thus the diester can be of, for example, glutaric acid and/or adipic acid.

Suitably, a dioctyl-, diisononyl or diisodecyl ester is employed. The diester can be of an aromatic acid, preferably of phthalic acid.

When the lubricating oil compositions of this invention contain an extreme pressure agent, this may be, for example, one or more phosphorus-sulphur organic compounds. One example of an extreme pressure agent is a phosphosulphurized polyalkene. When a VI improver is employed, it may be selected from styrene-butadiene copolymers, polymethacrylates and polyisobutenes. When a pour point depressant is employed it may be a chlorinated wax-naphthalene condensate and/or an ester type polymer or copolymer, for example a vinyl acetate-fumarate ester copolymer.

The mineral oil component of compositions according to the invention will be selected from those grades having the characteristics suitable for conventional gear oil or axle oil formulations. Thus, for example, suitable grades are 90 Neutral, 100 Neutral and 600 Neutral.

The final composition will have viscosity gradings of 75W, or 75W-80W, or 75W-90.

The invention will now be illustrated by reference to the following non-limitative Examples:

EXAMPLE 1

Table 1 attached shows a comparison of physicochemical characteristics between (a) two gear oil compositions according to the invention (L1 and L2) (b)

two fully synthetic gear oil types (E and F) and (c) four conventional mineral gear oils (R1, R'1, R2 and R3).

In Table 1 PAO=polyalphaolefins; PEG=the commercial product EMKAPYL 2000; ESTER=diisodecyl adipate; EP treat is 1:1 active ingredients to diluent; PMA=polymethacrylates; PIB=polyisobutylene; and the pour depressant was a chlorowax/naphthalene condensate.

Among other observations which can be made, it will be apparent that the equivalent grades L2 and F have virtually the same VI, but this has been obtained in the oil L2 of the invention with 33% less VI improver.

Furthermore the viscosity of oils L1 and L2 meet the U.S. Military gear oil specification MIL-L-2105C limits, which are

| 75W-80W | | 75W-90 | | |
|---|---|---|---|---|
| min | max | min | max | |
| 7.0 | — | 13.5 | 24.0 | (cSt at 100° C.) |

EXAMPLE 2

Samples of the gear oil compositions E, F, R1, L1, L2 and R2 shown in Table 1 were subjected to a FZG rig test. The results are shown in the accompanying FIGURE. This is a standard procedure of the Coordinating European Council (CEC). The particular test L-07-A-71 referred to in FIG. 1 determines damaging load. The plots recorded on the graph denote electric power consumption of the electric motor during test operation of the rig (the reading being taken from the watt meter on the motor) on various oil compositions, in comparison with a reference mineral oil composition $R_2$ (a GL-5 (API designation) 80W-90 grade).

FIG. 1 shows that, versus the reference oil R2, the oils of the invention (75W-80W and 75W-90 grades referenced L1 and L2 respectively) permit a decrease of power losses due to friction; while the fully synthetic 75W-90 oils based either on all ester basestocks or polyalphaolefins+polyisobutene type thickener do not (reference E and F respectively).

A mineral 75W-80W oil (reference R1) also permits an energy saving but only at low loads; as a fact in the FZG rig test, the saving is only obtained for loads inferior to the 6th Stage; for the higher load stages, this mineral 75W-80W oil gives a power loss increase likely due to insufficient oil film thickness (boundary lubrication). The oils L1 and L2 of the invention permit meeting the 9th FZG load stage before boundary lubrication starts.

EXAMPLE 3

A rear axle endurance bench test was conducted on a rear axle of an automobile of 1.6 l engine capacity. The test used the oil compositions R1, R'1, L1, L2 and R2 of Example 1. The test rig employed was a conventional rear axle rig. The test conditions and procedure were as follows:

| ° CYCLIC PROCEDURE | TEST CONDITIONS HIGH TORQUE LOW SPEED | LOW TORQUE HIGH SPEED |
|---|---|---|
| DURATION, H | 15 (DAY) | 9 (NIGHT) |
| REAR AXLE SPEED, RPM | | |
| INLET | 1380 | 4000 |
| OUTLET | 350 | 1020 |
| TORQUE AT REAR AXLE, m.N | | |
| INLET | 325 | 100 |
| OUTLET | 1270 | 390 |
| OIL TEMPERATURE, °C. | 145-150 | 125-130 |

The results are shown in Table 2. An advantage of the semi-synthetic formulations of the invention is seen in the transmission durability. Table 2 shows the insufficiency of mineral gear oils (75W-80W) as far as life duration of the transmission is concerned. In this endurance rig test run under severe conditions, the test duration after which rear axle damaging starts is only 57 hours, while it is 90 for a conventional mineral GL-5 gear oil (R2) containing the same extreme-pressure additive treatment (6.5 wt%). An extreme-pressure additive overtreat (oil R'1) does not improve the performance enough to match the mineral SAE 90 oil.

With the normal GL-5 additive treatment (6.5 wt%) the semi-synthetic 75W-80W oil L1 permits a longer life duration: 115 hours versus oil R2 although it has the same viscosity as the mineral 75W-80W oils R1 or R'1. This better anti-wear performance is confirmed by the result given by the 75W-90 semi-synthetic oil L2 which permits 150 hours duration life although it has the same viscosity at 100° C. as the G1-5-SAE 90 mineral reference oil R2.

EXAMPLE 4

The accompanying Table 3 shows the results of miscibility tests of an oil of the invention with a conventional mineral gear oil. The oil L1 of the invention and mineral oil R2 were taken.

The results illustrate a further, very important, advantage of an oil according to the invention. It provides the possibility for a car user to change from a conventional mineral gear oil to an oil of the invention without any special precautions in the oil-change. It also allows top-up. Table 3 shows that no phase separation will occur for an oil temperature above 40° C. whatever the ratio of oils types. For temperatures between 0° to 40° C., 30% max mineral oil can be added to the semi-synthetic one either through top-up or through oil remaining in the box after an oil draining, which is considered sufficient for the practical and usual case.

This miscibility with conventional products is considered essential by the car manufacturers and the U.S. official specification MIL-L-2105C.

TABLE 1

OILS COMPOSITION AND PHYSICO CHEMICAL CHARACTERISTICS

| Oil type | Claimed semi-synthetic oils | | synthetic oils | | conventional mineral oils | | | |
|---|---|---|---|---|---|---|---|---|
| Oil reference | L1 | L2 | E | F | R1 | R'1 | R2 | R3 |
| Viscosity grading | 75W-80 | 75W-90 | 75W-90 | 75W-90 | 75W-80W | 75W-80W | 80W-90 | 85W-140 |
| Composition (weight pct) | | | | | | | | |
| 150 Neutral | 38.5 | — | — | — | 72.5 | 69.0 | 68.5 | 9.40 |

TABLE 1-continued

OILS COMPOSITION AND PHYSICO CHEMICAL CHARACTERISTICS

| Oil type | Claimed semi-synthetic oils | | synthetic oils | | conventional mineral oils | | | |
|---|---|---|---|---|---|---|---|---|
| Oil reference | L1 | L2 | E | F | R1 | R'1 | R2 | R3 |
| Viscosity grading | 75W-80 | 75W-90 | 75W-90 | 75W-90 | 75W-80W | 75W-80W | 80W-90 | 85W-140 |
| 600 Neutral | — | 23.0 | — | — | 16.0 | 16.0 | 68.5 | — |
| 2500 Neutral | — | — | — | — | | | 23.0 | 84.3 |
| PAO Basestock | — | — | — | 81.0 | — | — | — | — |
| PEG oil | 16.0 | 16.0 | — | — | — | — | — | — |
| Ester | 36.5 | 46.0 | 70.0 | — | — | — | — | — |
| EP treat | 6.5 | 6.5 | 6.5 | 6.5 | 6.5 | 10.0 | 6.5 | 6.5 |
| VI Improver: Styrene-butadiene type | 2.0 | 8.0 | — | — | — | — | — | — |
| VI Improver: PMA type | — | — | 23.0 | — | 3.0 | 3.0 | — | — |
| VI Improver: PIB type | — | — | — | 12.0 | — | — | — | — |
| Pour depressant | 0.5 | 0.5 | 0.5 | 0.5 | 2.0 | 2.0 | 2.0 | 0.2 |
| Physico-chemical characteristics | | | | | | | | |
| Viscosity at 100° C., cSt | 7.9 | 17.2 | 19.0 | 16.0 | 7.8 | 7.8 | 14.0 | 24.0 |
| Brookfield viscosity at −90° C. | 1200 | 1300 | 700 | 1100 | 1200 | 1250 | ≧1500 | ≧1500 |
| Viscosity index ASTM D 2270 | 176 | 206 | 193 | 205 | 126 | 126 | 105 | 97 |

TABLE 2

REAR AXLE ENDURANCE BENCH TEST

| | | | | | |
|---|---|---|---|---|---|
| SAE VISCOSITY GRADING | | 75W-80W | | 75W-90 | 90 |
| OIL TYPE | M | M | SS | SS | M |
| REFERENCE | R1 | R'1 | L1 | L2 | R2 |
| TEST DURATION BEFORE AXLE DAMAGING, h | 57 | ABOUT 60-80 | 115 | 150 | 90 |
| TEMPERATURE CONTROL (1) | DIFFICULT (155 220°) (after 50 h) | GOOD | GOOD | GOOD | GOOD |
| ASPECT AFTER 100 h | | | | | |
| CONICAL GEAR | | | GOOD, VERY SLIGHTLY PITTING | GOOD | RIDGING + PITTING |
| CROWN | TEST STOPPED AFTER 57 h | | GOOD | GOOD | RIDGING + SLIGHT PITTING |
| ASPECT AFTER TEST COMPLETION | 57 h | 100 h | 115 h | 175 h | 115 h |
| CONICAL GEAR | HEAVY RIDGING | HEAVY PITTING | GOOD WITH HEAVY PITTING AT TEETH FOOT | GOOD WITH PITTING AT TEETH FOOT | HEAVY RIDGING + PITTING |
| CROWN | RIDGING | | GOOD | SLIGHT PITTING | RIDGING + PITTING |
| REAR ROLLING | SCALING | | SCALING | PITTING | HEAVY SCALING |
| LATERAL ROLLINGS | SCALING | | SCALING | SCALING | SLIGHT SCALING |

(1)maximum cooling is necessary to maintain 150° C. max at low torque - high speed, and becomes insufficient when axle damaging starts.

TABLE 3

MISCIBILITY WITH CONVENTIONAL MINERAL GEAR OILS

| | | | | | |
|---|---|---|---|---|---|
| Semi-Synthetic Oil | 90 | 75 | 50 | 25 | 10 |
| Mineral Oil | 10 | 25 | 50 | 75 | 90 |
| Miscibility | | | | | |
| at 100° C. | ←EXCELLENT(1)→ | | | | |
| 40° C. | ←EXCELLENT(1)→ | | | | |
| 20° C. | ←EXCELLENT→ ←CLEAR BUT SLIGHT SEPARATION→ AFTER 8 DAYS' STORAGE(2) | | | | |
| 0° C. | ←EXCELLENT→ ←CLEAR BUT SLIGHT SEPARATION→ AFTER 8 DAY' STORAGE(2) | | | | |
| −20° C. | ←HAZY(3)→ | | | | |
| −40° C. | ←HAZY(3)→ | | | | |

(1)Blend is clear and perfectly homogeneous.
(2)Blend separates into 2 phases after 8 day' storage without stirring, homogeneity is immediately recovered by stirring or by heating.
(3)Blend is hazy; clearness and homogeneity are recovered by heating at 40° C.

What we claim is:

1. A lubricating oil composition suitable for use as a gear oil or an axle oil comprising:

(a) from 5 to 50 mass % of mineral oil of conventional gear oil or axle oil grade;

(b) from 5 to 30 mass % in total of at least one polyoxyalkylene glycol having a viscosity of from 5 to 30 cSt at 100° C.;

(c) from 25 to 60 mass % in total of at least one di-$C_8$ to $C_{12}$ alkyl ester of a dicarboxylic acid;

(d) from 0 to 15 mass % in total of at least one conventional extreme pressure agent:

(e) from 0 to 8 mass % in total of at least one conventional VI improver; and (f) from 0 to 5 mass % of at least one conventional pour point depressant;

the components (a) to (f) totalling together 100 mass %, and said components (a) to (f) also representing at least 95 mass % of the whole lubricating oil composition.

2. A lubricating oil composition is claimed in claim 1, comprising:

from 10 to 40 mass % of component (a),
from 10 to 20 mass % of component (b),
from 30 to 35 mass % of component (c),
from 2 to 10 mass % of component (d),
from 2 to 5 mass % of component (e), and
from 0.1 to 3 mass % of component (f);

the components (a) to (f) totalling together 100 mass %, and said components representing forming at least 95 mass % of the whole lubricating oil composition.

3. A lubricating oil composition as claimed in claim 1 or claim 2 and containing 0 to 5 mass % in total of one or more conventional lubricating oil additives selected from the group consisting of anti-corrosion agents, antioxidants, seal-swellants, de-odourizers, dyes and fluorescent colouring agents.

4. A lubricating composition as claimed in claim 1, wherein the polyoxyalkylene glycol has a viscosity of from 20 to 25 cSt at 100° C.

5. A lubricating composition as claimed in claim 1, wherein the polyoxyalkylene glycol is selected from the group consisting of polyoxyethylene glycol, polyoxypropylene glycol and polyoxyethylene-polyoxypropylene glycol.

6. A lubricating oil composition as claimed in claim 1, wherein the said diester component (c) is a diester of an aliphatic dicarboxylic acid.

7. A lubricating oil composition as claimed in claim 6, wherein the diester is a diester of an aliphatic dicarboxylic acid of formula $HOOC(CH_2)_nCOOH$, where n is from 3 to 8.

8. A lubricating oil composition as claimed in claim 6, wherein the diester is selected from the group consisting of glutaric acid, adipic acid and mixtures of those two acids.

9. A lubricating oil composition as claimed in claim 1, wherein the said diester component (c) is of phthalic acid.

10. A lubricating oil composition as claimed in claim 1, wherein the said at least one extreme pressure agent, when employed, is at least one phosphorus- and sulphur-containing organic compound.

11. A lubricating oil composition as claimed in claim 1, wherein the at least one VI improver, when employed, is selected from the group consisting of styrene-butadiene copolymers, polymethacrylates, polyisobutenes and mixtures thereof.

12. A lubricating oil composition as claimed in claim 1, wherein the at least one pour point depressant, when employed, is selected from the group consisting of chlorinated wax-naphthalene condensates, vinyl acetate-fumarate ester copolymers and mixtures thereof.

* * * * *